US006367734B1

(12) United States Patent
Cartwright

(10) Patent No.: US 6,367,734 B1
(45) Date of Patent: Apr. 9, 2002

(54) UNIVERSAL PAPER ROLL HOLDER

(76) Inventor: Madeline Cartwright, 639 Ardmore Ave., Ardmore, PA (US) 19003

( * ) Notice: Subject to any disclaimer, the term of this patent is extended or adjusted under 35 U.S.C. 154(b) by 0 days.

(21) Appl. No.: 09/586,512

(22) Filed: Jun. 2, 2000

(51) Int. Cl.[7] ..... B65H 16/06

(52) U.S. Cl. ..... 242/599.1; 242/5; 242/598.1; 242/598.3

(58) Field of Search ..... 242/599.1, 598, 242/598.1, 598.3, 596, 596.5, 599.3

(56) References Cited

U.S. PATENT DOCUMENTS 688,253 A 12/1901 Kelly
952,708 A 3/1910 Meahl
1,778,856 A 10/1930 Hoegger
3,655,144 A 4/1972 Turner ..... 242/68
4,925,102 A 5/1990 Jones et al. ..... 239/52
5,165,620 A 11/1992 Kampiziones ..... 242/72.1
5,588,627 A 12/1996 Sharpe ..... 242/599

*Primary Examiner*—Christopher P. Ellis
*Assistant Examiner*—Jonathan R Miller
(74) *Attorney, Agent, or Firm*—Robert S. Lipton, Esq.; Lipton, Weinberger & Husick

(57) ABSTRACT

An apparatus that can adapt a toilet tissue holder into a paper towel holder. The apparatus can be sold in kit forms so that a person can convert a standard toilet tissue holder into a holder for paper towels thus insuring that the style and design of the fixtures match.

4 Claims, 4 Drawing Sheets

UNIVERSAL PAPER ROLL HOLDER

FIELD OF THE INVENTION

The present invention relates generally to holders for paper products packaged as rolls and, more specifically, for a universal paper towel and toilet tissue holder.

BACKGROUND OF THE INVENTION

Paper products are commonly packaged in rolls. For example, paper towels and toilet tissue are wrapped around a paper tube, and sold and dispensed as a roll. Paper towels are perforated at predetermined distances so that they can be torn off the roll after a desired length has been dispensed. Paper towels are typically eleven inches wide; accordingly, the paper tube around which a roll of paper towels is wound is eleven inches long. Similarly, the paper tube around which toilet tissue is wound is four and one-half inches long.

An apparatus for holding and dispensing toilet tissue in a bathroom is well known. Similarly, an apparatus for holding and dispensing paper towels in the kitchen or other area is also well known. Both apparatuses comprise a pair of brackets that are attached to a relatively flat surface and are designed to support a rod there between. The brackets are mirror images of each other (i.e., a left-hand bracket and a right-hand bracket). Each bracket is designed to be mounted on a substantially flat surface (i.e., on a wall or under a cabinet).

The rod is designed to have a diameter that is less than the diameter of the paper tube around which the roll of paper towels or roll of toilet tissue is wound. The rod is usually made of two substantially cylindrical sections; each cylindrical section has an axial projection at one end for inserting into its respective bracket. The first section has a slightly smaller diameter than the second section so that the first section slides into the second section in a telescoping manner. Also, each section is slightly longer than one-half as long as the desired rod length.

A spring having an axially length slightly longer than the length of the rod (or the combined length of the two rod sections) is inserted into each section. The spring within the rod is compressed by applying axial pressure to one or both of the sections and allowing the smaller diameter section to slide into the larger diameter section. The brackets are usually glued, or attached with screws, to the wall or other substantially flat surface and spaced apart at a distance slightly longer than the length of the paper roll it is intended to support.

The brackets are mounted such that the distance between the brackets is slightly less than the length of the rod when it is at rest, but slightly longer than the paper roll it is designed to hold. When the rod is placed under axial compressive pressure, the overall length of the rod becomes momentarily less than the spacing between the two brackets. The axial projection from an end of either rod section is inserted into one of the brackets and, while still depressing the spring, the axial projection of the second rod section is aligned with the other bracket. The compressive pressure is released until the brackets have received both axial projections, thereby securing the rod between the two brackets by the force provided by the spring in an outward axial direction.

When the toilet tissue or paper towel roll is completely consumed, the empty roll is removed by once again compressing the spring and disengaging one of the axial projections from its respective bracket then disengaging the second axial projection from its respective bracket. The rod is slid out from the empty paper tube and inserted into a fresh roll of toilet tissue or paper towels; the rod is once again compressed and inserted between the two brackets.

It is highly desirable to have the style of the fixtures in a household match. For example, various door handles, appliances, faucets, light switch covers and receptacle covers usually coordinate with each other in material (e.g., brass), color, style, pattern and/or design within a room or throughout the house. Similarly, it is desirable to have the brackets that hold the toilet tissue and the brackets that hold the paper towels also match. This is especially true if there is a paper towel dispenser in the bathroom, or in another room in close proximity to the bathroom.

Unfortunately, it is not always possible to match the brackets of the toilet tissue holder with the brackets of the paper towel holder. Often, a store does not have an equal number of paper towel holders and toilet tissue holders available. The exact reason for this phenomena is unknown; however, it could be because one of the paper product holders is more easily broken or more often replaced than the other paper product holder. At other times, the manufacturer either discontinues making one paper product holder or decides to not manufacture matching holders.

SUMMARY OF THE INVENTION

The present invention discloses a universal paper towel/toilet tissue holder and/or an aftermarket apparatus that converts a standard toilet paper holder into a paper towel holder.

The present apparatus may be sold in a universal kit form so that a homeowner can decide whether to use the apparatus as a toilet tissue holder or as a paper towel holder.

The subject apparatus consists of a spindle with an at rest length approximate that of a roll of paper towels. The spindle has means for adjusting the length of the rod to a degree that is less than the length of a toilet tissue roll when inward axial pressure is applied to the spindle and a means for returning the spindle to its at rest length when the axial pressure is removed. In a preferred embodiment, the means for adjusting the length of the spindle is an elongated spring that is inserted in the interior of two hollow sections of the spindle. The subject apparatus also includes a shaft having first and second ends wherein the first end of said shaft has an axial pin (similar in dimension to the axial end projections on the spindle) and the second end of the shaft is adapted to receive at least a portion of the spindle such that the longitudinal axies of the shaft and the spindle are substantially coaxial. The shaft has a length such that when the spindle is fully inserted into the shaft, the total length of the shaft and spindle is slightly longer than the length of a roll of paper towels.

Another primary component of the subject apparatus is a pair of brackets that are adapted to be attached to a substantially flat, fixed surface. Each of the brackets include a means for receiving the axial end projections of the spindle when the brackets are used to hold a roll of toilet tissue; the same brackets can receive either an axial end projection of the spindle or the axial pin of the shaft for supporting either the spindle alone or supporting the spindle and shaft when the spindle has been inserted into the second end of the shaft.

The overall length of the spindle/shaft assembly is slightly longer than the length of a paper towel roll. When the brackets are secured to the wall or other surface, the distance separating the brackets is slightly larger than the average length of a roll of paper towels. As the spindle is compressed the overall length of the spindle/shaft assembly becomes less than the distance between the brackets such that the spindle/shaft assembly can then be inserted between and aligned with the brackets; as the axial pressure on the spindle is released, its end projection enters into the receptacle of its corresponding bracket and the axial pin of the shaft enters into the receptacle of the other bracket such that the roll of paper towels is suspended there from.

DETAILED DESCRIPTION OF THE PREFERRED EMBODIMENT

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Preferred embodiments of the present invention will now be described in detail with reference to the accompanying drawings in which a universal paper roll holder in accordance with the present invention is shown.

Figure 1:
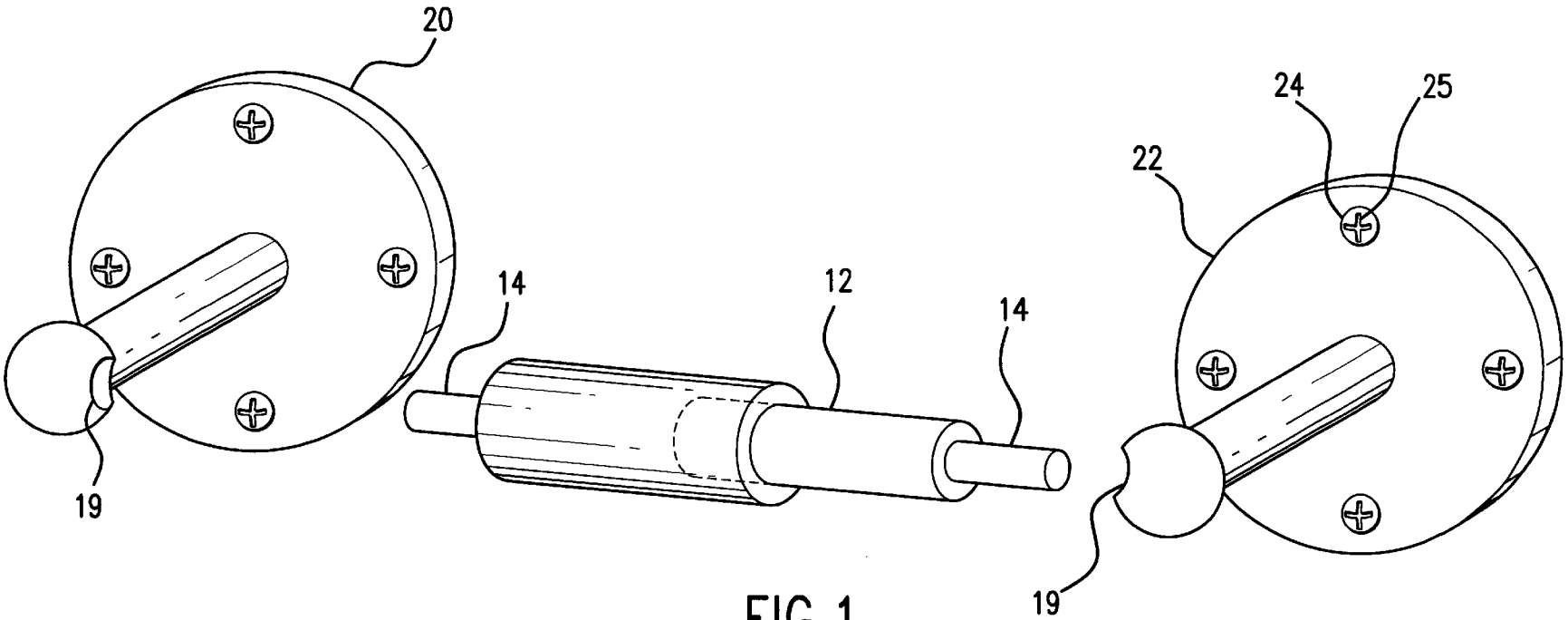
FIG. 1 is a perspective view of a toilet tissue holder in accordance with the present invention.

A spindle 12 is illustrated in FIG. 1. The spindle 12 includes axial end projections 14 that project outward from the center of the spindle. The spindle has a length proximate the length of the smallest width of a paper product which is to be used. Although it is understood that the present apparatus may be used to adjust the length of the spindle between any two widths of roll paper products, the following examples will illustrate the conversion between a toilet tissue holder and a paper towel holder.

Figure 2:
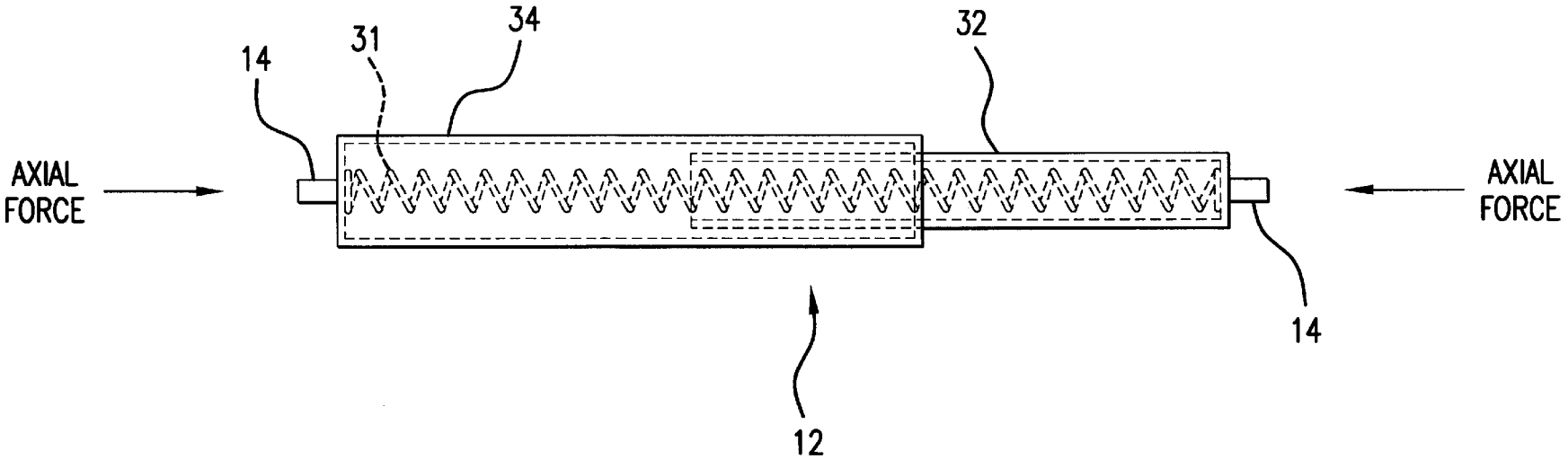
FIG. 2 is a perspective view of the spindle illustrated in FIG. 1 being compressed under axial force.

The spindle 12 includes means for decreasing its length upon the application of an inward axial pressure as illustrated in FIG. 2. This is sometimes referred to as axial compression. The degree of decrease is determined by a number of factors as will be explained below.

The spindle 12 can be of the type commonly used and sold for toilet tissue holders. For example, a common design is to have a first sleeve 32 having a first diameter and a second sleeve 34 having a second diameter that is larger than said first diameter so that said first sleeve is able to slide into the second sleeve in a telescoping manner. The sleeves are hollow such that an elongated coiled spring is able to be inserted inside both sleeves. The length of the coiled spring 31 is preferably slightly longer than the length of the spindle 12 (i.e., the combined length of first sleeve 32 and second sleeve 34). When axial pressure is applied to both ends of the spindle, the second sleeve receives the first sleeve while the coiled spring is being compressed inside the two sleeves.

In the preferred embodiment, the smallest paper roll length would correspond to the width of a toilet tissue roll. Since the standard width of a toilet tissue sheet is 4½ inches, the spindle 12 is approximately 5½ inches long (not counting the axial end projections), when the spring is at rest.

The amount or degree of decrease in the length of the spindle depends on the elasticity of the spring and the approximate lengths of the sleeve. In the preferred embodiment, first and second sleeves 32, 34 are each approximately three inches long.

Referring again now to FIG. 1, a pair of brackets 20, 22 are shown. The brackets are substantially identical to each other except that they are mirror images of each other. Accordingly, there may be an occasional reference to a left bracket 20 and a right bracket 22 herein.

The brackets 20, 22 are designed to be secured or attached to a substantially flat surface. In the case of toilet tissue brackets, the flat surface is a wall in close proximity to the toilet. In the case of paper towels in the kitchen, the brackets are commonly secured underneath a cabinet. The means for securing the brackets to the flat surface can be a combination of mounting holes 24 in the base of the bracket and an equal number of mounting screws 25.

The brackets 20, 22 include a receptacle 19 for accepting the axial end projections 14 from the spindle 12 thereby supporting the spindle (and the roll of toilet tissue suspended on the spindle) between the two brackets.

For a toilet tissue holder, the brackets 20, 22 are placed approximately 5¼ inches apart which is slightly larger than the length of a toilet tissue roll. This provides some play in the axial direction to allow the toilet tissue roll to rotate without being impeded by the brackets. The spindle 12 is inserted through the toilet tissue roll and is axially compressed so that the compressed spindle can be placed between the brackets and the axial end projections 14 aligned with the receptacles in the brackets thereby supporting the spindle 12 and the toilet tissue roll. Note that the "at rest" length of the spindle is approximately 5½ inches, so when the spindle is positioned between the brackets, the spring 31 is slightly compressed thereby securing the spindle between the brackets.

Figure 3:
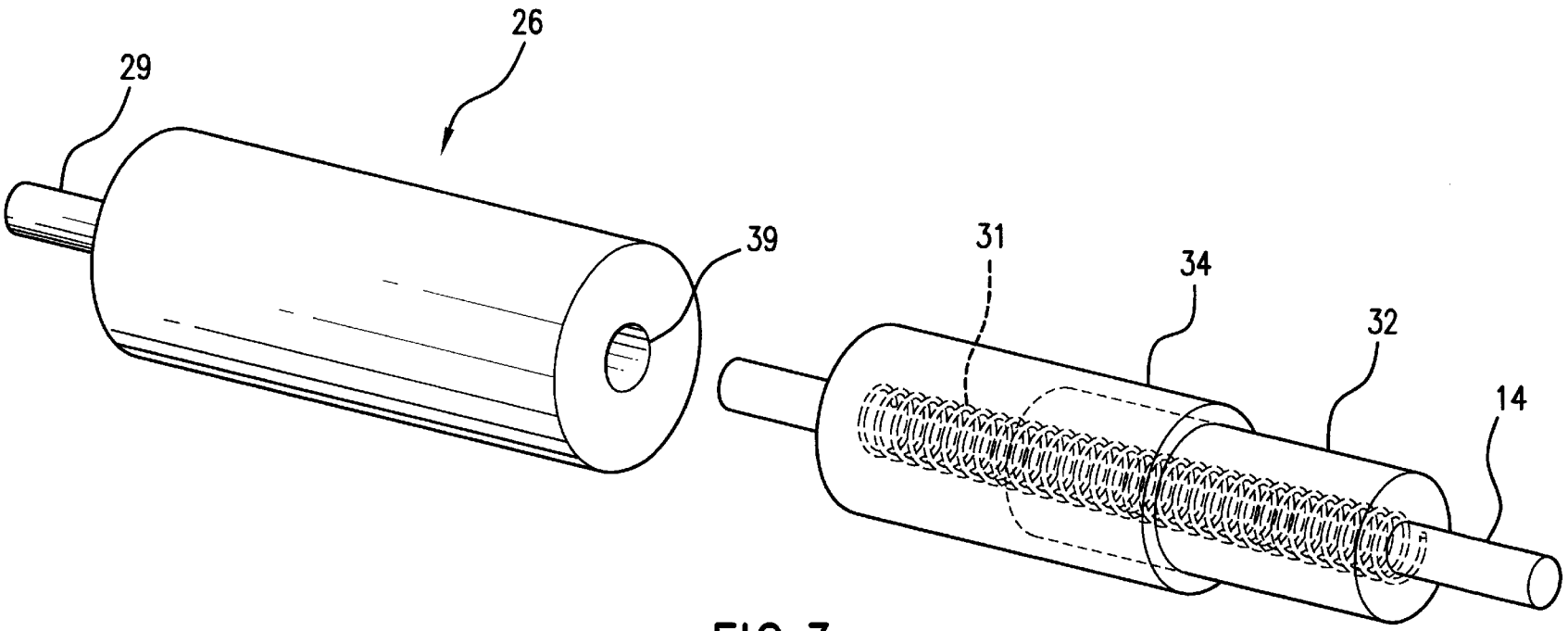
FIG. 3 is an exploded view of the apparatus in accordance with the present invention which converts a toilet tissue holder into a paper towel holder.

Referring now to FIG. 3, an important part of the present invention is a shaft 26. The shaft 26 has first and second ends wherein said first end has an axial pin 29 and said second is designed to receive at least a portion of spindle 12. The shaft 26 is larger in diameter than the outside diameter of second sleeve 34 but smaller in diameter than the tube of a paper towel roll.

The pin 29 has a length and diameter of the same general dimensions as the axial end projections 14 of the spindle. In this manner, the left bracket 20 or the right bracket 22 is able to receive the axial pin 29 of the shaft 26.

The second end of the shaft 26 is adapted with a bore hole 39 so that it can receive almost the entire second sleeve 34 of the spindle. The bore hole 39 is aligned so that the longitudinal axles of the shaft 26 and the spindle 12 are substantially coaxial. The shaft 26 is designed so that it does not interfere with the axial compression of the first sleeve 32 of spindle 12 within the second sleeve 34.

The shaft 26 may be of any desirable length to accommodate the corresponding length of a roll of paper. As explained previously, in the preferred embodiment, the length of the shaft 26 is designed to support a roll of paper towels; accordingly, the shaft is approximately eleven inches long. When the spindle 12 is inserted into the second end of the shaft 26, the combined length of the shaft and spindle is approximately thirteen inches long (not counting the axial pin or the axial end projection).

The spindle 12 and the brackets may resemble the spindle and brackets for any typical toilet tissue holder. However, the shaft 26 is designed to preferably receive the sleeve 34 of the spindle that has the larger diameter. In this manner, the elongated spring within the interior of the spindle 26 may still be compressed under axial pressure allowing the smaller diameter sleeve 32 of the spindle to be slid inside the larger diameter sleeve 34.

Figure 4:
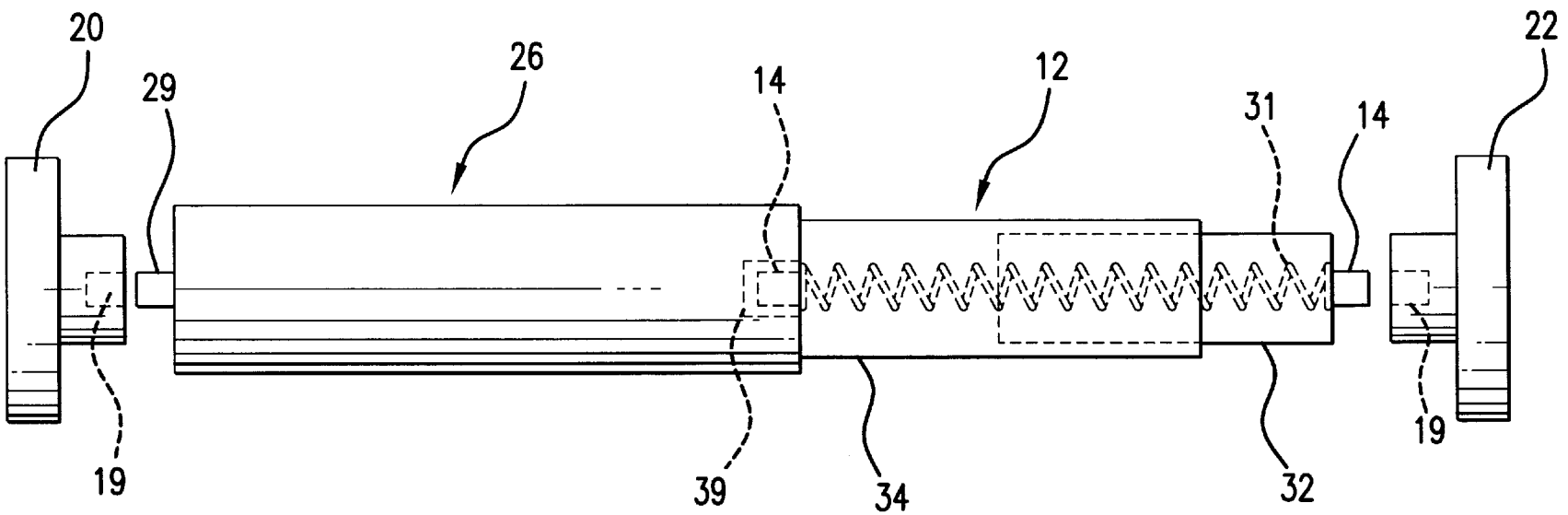
FIG. 4 is a perspective view of the spindle/shaft assembly in accordance with the present invention.

As illustrated in FIG. 4, the spindle 26 is still able to decompress under axial pressure. After a typical roll of paper towels is slid over the shaft/spindle assembly, the spindle is compressed. The first sleeve 32 projects partially out from the roll of paper towels. Axial force is applied to the first sleeve 32 thereby reducing the length of the spindle/shaft assembly and allowing the assembly to be positioned between the two brackets.

The axial end projection 14 of first sleeve 32 is aligned with the receptacle in its respective bracket and the axial pin 29 of the rod is aligned with the receptacle in the remaining bracket. When the axial pressure is released, the brackets support the spindle/rod assembly and the paper towel roll.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

What is claimed is:

1. An apparatus for supporting a roll of paper, the apparatus comprising:

(a) a spindle with an at-rest axial length approximate that of a toilet tissue roll, said spindle having means for adjusting said length to a degree that is less than the axial length of a toilet tissue roll under inward axial pressure and for returning said spindle to the spindle's at-rest axial length when the axial pressure is removed, said spindle having axial end projections;

(b) a shaft having first and second ends, said first end of said shaft having an axial pin having a length and diameter of a general magnitude of said axial end projection of the spindle; said second end of said shaft being adapted to receive at least a portion of said spindle such that the longitudinal axles of said shaft and said spindle are substantially coaxial, said shaft having a predetermined length; and (c) a pair of brackets able to be attached to a substantially flat, fixed surface, each of said brackets including means for receiving said axial end projections of the spindle and said axial pin of the shaft for supporting either the spindle alone or supporting said spindle and said shaft when in their coaxial position.

2. The apparatus of claim 1 wherein said means for adjusting said spindle length comprises a spring.

3. The apparatus of claim 2 wherein said means for adjusting said spindle further comprises a first sleeve having a first diameter and a second sleeve having a second diameter that is larger than said first diameter so that said first sleeve is able to slide into said second sleeve, and wherein both sleeves are adapted for receiving said spring.

4. The apparatus of claim 3, wherein said predetermined axial length of said shaft is such that when said spindle is received by said shaft, the overall axial length is slightly longer than the length of a roll of paper towels.

* * * * *